US007572117B2

(12) United States Patent
Hosono

(10) Patent No.: US 7,572,117 B2
(45) Date of Patent: Aug. 11, 2009

(54) INNER ROTOR OF INTERNAL GEAR PUMP HAVING CONVEX SMALL CIRCULAR ARC PARTS

(75) Inventor: Katsuaki Hosono, Niigata (JP)

(73) Assignee: Mitsubishi Materials PMG Corporation, Nigata-Ken (JP)

( * ) Notice: Subject to any disclaimer, the term of this patent is extended or adjusted under 35 U.S.C. 154(b) by 18 days.

(21) Appl. No.: 11/721,228

(22) PCT Filed: Jan. 12, 2005

(86) PCT No.: PCT/JP2005/000233

§ 371 (c)(1),
(2), (4) Date: Jun. 14, 2007

(87) PCT Pub. No.: WO2006/075363

PCT Pub. Date: Jul. 20, 2006

(65) Prior Publication Data

US 2008/0232994 A1 Sep. 25, 2008

(51) Int. Cl.
*F04C 18/00* (2006.01)
*F04C 2/00* (2006.01)

(52) U.S. Cl. ..... 418/171; 418/109; 418/179; 403/359.6; 403/365; 403/404; 464/160; 464/179

(58) Field of Classification Search ..... 418/166, 418/171, 170, 109, 150, 178, 179; 403/359.5, 403/359.6, 365, 404; 464/89, 140, 160, 179
See application file for complete search history.

(56) References Cited

U.S. PATENT DOCUMENTS

| | | | | |
|---|---|---|---|---|
| 5,163,826 | A | 11/1992 | Cozens et al. | |
| 5,199,971 | A * | 4/1993 | Akechi | 418/171 |
| 5,226,798 | A | 7/1993 | Eisenmann | |
| 6,089,843 | A * | 7/2000 | Kondoh | 418/179 |
| 6,676,394 | B2 * | 1/2004 | Bodzak | 418/171 |
| 6,679,692 | B1 * | 1/2004 | Feuling | 418/171 |

FOREIGN PATENT DOCUMENTS

| | | |
|---|---|---|
| DE | 39 38 346 | 4/1991 |
| JP | 59-107987 U | 7/1984 |
| JP | 60-180783 U | 11/1985 |
| JP | 61-223282 A | 10/1986 |
| JP | 63-223382 A | 9/1988 |
| JP | 11-343985 A | 12/1999 |
| JP | 2004-332754 A | 11/2004 |

* cited by examiner

*Primary Examiner*—Theresa Trieu
(74) *Attorney, Agent, or Firm*—Darby & Darby P.C.

(57) ABSTRACT

A crankshaft and an mounting hole have two main circular arc parts on the same circle; and two connecting parts for connecting the adjacent main circular arc parts, and have a cross-sectional shape in which the connecting parts facing each other are substantially parallel. The connecting parts of the mounting hole are formed in the shape of a large circular arc which projects inward. The torque of the crankshaft is transmitted to the mounting hole in a state where the connecting parts of the crankshaft and the connecting parts of the mounting hole which are formed in the shape of a large circular arc come into line contact with each other; therefore, the value of any local stress generated in the mounting hole can be reduced.

7 Claims, 16 Drawing Sheets

INNER ROTOR OF INTERNAL GEAR PUMP HAVING CONVEX SMALL CIRCULAR ARC PARTS

CROSS REFERENCE TO RELATED APPLICATIONS

This is a U.S. national phase application under 35 U.S.C. §371 of International Patent Application No. PCT/JP2005/000233, filed Jan. 12, 2005. The International Application was published in Japanese on Jul. 20, 2006 as International Publication No. WO 2006/075363 under PCT Article 21(2) the content of both are incorporated herein in their entirety.

TECHNICAL FIELD

The present invention relates to an inner rotor of an internal gear pump which meshes with an outer rotor, and more specifically, relates to an inner rotor of an internal gear pump in which a mounting hole that allows a driving shaft to be inserted thereinto is formed in an axis, the mounting hole has a cross-sectional shape substantially corresponding to the driving shaft, and torque is transmitted by the driving shaft inserted into the mounting hole.

BACKGROUND ART

As a general internal gear pump that is known widely, there is a trochoidal pump utilizing a trochoidal tooth profile for an inner rotor and an outer rotor. In the trochoidal pump, as the inner rotor is rotationally driven, the outer rotor which meshes with the inner rotor is rotated in the same direction as the inner rotor. This rotation increases and decreases the volume of a pump chamber formed between contact parts of the rotors, thereby suctioning a fluid from a suction port and discharging the fluid from a discharge port. Since this trochoidal pump has advantages, such as good efficiency and ease of fabrication, it has come into wide use.

The internal gear pump as described above is used as an oil pump of a prime mover, and the inner rotor is rotationally driven by using a crankshaft of the prime mover as the driving shaft (for example, Japanese Unexamined Patent Application, First Publication No. H11-343985 (FIG. 8, Paragraph 0019)).

An example of the internal gear pump will now be described with reference to FIG. 14. Specifically, an internal gear pump 1 is assembled such that an inner rotor 4 is inscribed to an outer rotor 3 in an eccentric state in a rotor chamber 12A of a casing 2. The outer rotor 3 has internal teeth 3A formed in the shape of circular arc teeth at an inner periphery thereof, while the inner rotor 4 has external teeth 4A formed in the shape of trochoidal teeth at an outer periphery thereof. These outer and inner rotors mesh with each other while forming a plurality of voids. The number of the external teeth 4A of the inner rotor 4 is one less than the number of the internal teeth 3A. Also, the outer rotor 3 is rotatably fitted into the rotor chamber 12A of the casing 2. Moreover, the inner rotor 4 has a mounting hole 5 in the central axis thereof, and a crankshaft 6 that is a driving shaft is inserted into and connected to the mounting hole 5. Furthermore, a suction port 7 and a discharge port 8 are formed in the rotor chamber 12A of the casing 2 with the central axes of both the rotors 3 and 4 therebetween. When the internal gear pump is used, the inner rotor 4 rotates via the crankshaft 6. With the rotation of the inner rotor, the outer rotor 3 also rotates in the same direction by engagement between the internal teeth 3A and the external teeth 4A. While the outer rotor 3 and the inner rotor 4 make one rotation, the volume of each void part increases or decreases whereby oil is suctioned in the suction port 7, and oil is discharged from the discharge port 8.

Also, in the internal gear pump 1 in which the inner rotor 4 is rotated by the crankshaft 6 of an engine, in order for the crankshaft 6 to be inserted into and connected to the mounting hole 5 of the inner rotor 4 after the outer rotor 3 and the inner rotor 4 are assembled into the casing 2, a clearance that enables insertion is provided between the mounting hole 5 and the crankshaft 6 so that centering of the central axis of the inner rotor 4 can be obtained by engagement with the casing 2.

As the above engaging structure, for example, an axially projecting tubular part is provided at a side face of an inner rotor, a supporting hole which supports the tubular part is provided in a casing (for example, Japanese Unexamined Patent Application, First Publication No. S63-223382 (first line from the bottom in the lower right column of Page 2 to first line in the upper left column of Page 3, and FIGS. 5, 6, and 8)), and the supporting hole defines the center of rotation of the inner rotor. In this case, the clearance between the tubular part and the supporting hole is set smaller than the clearance between the mounting hole and the crankshaft.

In the structure in which a predetermined clearance is provided between the mounting hole and the crankshaft as described above, in order to positively transmit rotation of the crankshaft to the mounting hole, a pair of flat surfaces are formed at the outer periphery of the crankshaft (for example, Japanese Unexamined Patent Application, First Publication No. H11-343985 (FIG. 8, Paragraph 0019)), Japanese Unexamined Patent Application, First Publication No. S63-223382 (first line from the bottom in the lower right column of Page 2 to first line in the upper left column of Page 3, and FIGS. 5, 6, and 8).

When the above engaging structure between the crankshaft and a mounting hole is shown in FIGS. 15 and 16, the flat surfaces 6A and 6A are formed at the outer periphery of the crankshaft 6, the mounting hole 5 which the crankshaft 6 is inserted into and connected to is formed substantially in substantially the same shape, and predetermined clearances C are provided between the flat surfaces 6A of the crankshaft 6 and the mounting hole 5. In addition, in FIGS. 15 and 16, the clearances C are shown larger than the actual dimensions for the purpose of explanation. Accordingly, in the structure shown in FIGS. 15 and 16, rotational moment is transmitted to the mounting hole 5 at two corners 6B located on one side of the flat surfaces 6A of the crankshaft 6 in the direction of rotation thereof. For this reason, since stress is concentrated in the vicinity of corners 5A of the mounting hole 5, deterioration of durability is caused, and high surface pressure is generated in a transmission part, abnormal noises are apt to be generated. Also, when a sintered part is used for the inner rotor, it is necessary to secure the strength of the whole inner rotor in accordance to the maximum stress.

Moreover, since the corners 6B that are edges of the crankshaft 6 strike against the mounting hole 5, there is a problem in that the mounting hole 5 is worn out in the portion against which the corner 6B hits. Furthermore, if hard foreign objects enter the clearance between the mounting hole 5 and the crankshaft 6, the mounting hole 5 is damaged easily.

It is an object of the present invention to provide an inner rotor of an internal gear pump capable of relaxing any local stress concentration caused by a rotational moment transmitted from a driving shaft.

SUMMARY OF THE INVENTION

The present invention is an inner rotor of an internal gear pump in which a mounting hole that allows a driving shaft to be inserted thereinto is formed in an axis, the mounting hole has a cross-sectional shape substantially corresponding to the driving shaft, and torque is transmitted by the driving shaft.

Here, the driving shaft and the mounting hole have a cross-sectional shape including two main circular arc parts on the same circle and two connecting parts which connect both adjacent ends of the main circular arc parts, and the connecting parts of the mounting hole are recessed at their ends.

According to the configuration of the present invention, the connecting parts of the mounting hole are recessed at their ends. Therefore, corners of the crankshaft do not hit against corners of the mounting hole. As a result, any stress concentration caused by the transmission of rotation between the corners can be relieved.

Moreover, in the present invention, the connecting parts of the mounting hole may be formed in the shape of a large circular arc which projects inward.

According to the configuration, the torque of the driving shaft is transmitted to the mounting hole in a state where the connecting parts of the driving shaft and the connecting parts of the mounting hole which are formed in the shape of a large circular arc come into line contact with each other. Therefore, the value of any local stress generated in the mounting hole can be reduced. Moreover, since any local stress concentration can be suppressed in this way, generation of abnormal noises, etc. can be prevented.

Moreover, in the present invention, convex small circular arc parts having a small radius may be provided at both ends of each of the connecting parts of the mounting hole.

According to the configuration of, the torque of the driving shaft is transmitted to the mounting hole in a state where the connecting parts of the driving shaft and one of the convex small circular arc parts of the mounting hole come into line contact with each other or in a state where the connecting parts of the driving shaft and the connecting parts of the mounting hole come into surface contact with each other. Therefore, any local stress generated in the mounting hole can be reduced.

Moreover, in the present invention, the connecting parts of the mounting hole may be located outside inner ends of the convex small circular arc parts.

According to the configuration, the torque of the driving shaft is transmitted to the mounting hole in a state where the connecting parts of the driving shaft and at least one of the convex small circular arc parts of the connecting parts of the mounting hole come into line contact with each other. Therefore, any local stress generated in the mounting hole can be reduced.

Moreover, in the present invention, recesses that are recessed may be provided at corners of the mounting hole so as to correspond to corners of the driving shaft in places where the main circular arc parts and the connecting parts are connected.

According to the configuration, the corners of the driving shaft do not hit against the corners of the mounting hole by providing the recesses.

Moreover, in the present invention, the recesses may be circular arc cutouts having a small radius.

According to the configuration, any stress generated in the vicinity of the corners of the mounting hole can be reduced.

Moreover, in the present invention, the recesses are formed by recessing ends of each of the main circular arc parts of the mounting hole.

According to the configuration, any stress generated in the vicinity of the corners of the mounting hole can be reduced.

Moreover, in the present invention, the inner rotor is a ferrous sintered member.

According to the configuration, since the inner rotor is a ferrous sintered member, shaping of the mounting hole is easy.

Moreover, in the present invention, the sintered member may be an Fe—Cu—C-based sintered member having a density of 6.6 to 7.0 $cm^3$.

According to the configuration, parts having a lower density than a conventional article can be used, and product cost can be reduced.

Moreover, in the present invention, the driving shaft may be connected to a crankshaft of a prime mover.

According to the configuration, even under the vibrating conditions of the prime mover, generation of abnormal noises can be prevented. As a result, an inner rotor having excellent durability can be obtained.

EFFECTS OF THE INVENTION

According to the present invention, the driving shaft and the mounting hole have a cross-sectional shape including two main circular arc parts on the same circle and two connecting parts which connect both adjacent ends of the main circular arc parts, and the connecting parts of the mounting hole are recessed at their ends. Thus, any local stress concentration caused by the rotational moment transmitted from the driving shaft can be relaxed.

Moreover, according to the present invention, the connecting parts of the mounting hole are formed in the shape of a large circular arc which projects inward. Thus, any local stress concentration caused by the rotational moment transmitted from the driving shaft can be relaxed.

Moreover, according to the present invention, convex small circular arc parts having a small radius are at both ends of each of the connecting parts of the mounting hole. Thus, any local stress concentration caused by the rotational moment transmitted from the driving shaft can be relaxed.

Moreover, according to the present invention, the connecting parts are located outside inner ends of the convex small circular arc parts. Thus, any local stress generated in the mounting hole can be reduced.

Moreover, according to the present invention, recesses that are recessed are provided at corners so as to correspond to corners of the driving shaft in places where the main circular arc parts and the connecting parts are connected. Thus, the corners of the driving shaft do not hit against the corners of the mounting hole.

Moreover, according to the present invention, the recesses are circular arc cutouts having a small radius. Thus, any stress generated in the vicinity of the corners of the mounting hole can be reduced.

Moreover, according to the present invention, the recesses are formed by recessing ends of each of the main circular arc parts of the mounting hole. Thus, any stress generated in the vicinity of the corners of the mounting hole can be reduced.

Moreover, according to the present invention, the inner rotor is a ferrous sintered member. Thus, shaping of the mounting hole is easy.

Moreover, according to the present invention, the sintered member is an Fe—Cu—C-based sintered member having a density of 6.6 to 7.0 $cm^3$. Thus, parts having a lower density than a conventional article can be used, and product cost can be reduced.

Moreover, according to the present invention, the driving shaft is connected to a crankshaft of a prime mover. Thus, even under the vibrating conditions of the prime mover, generation of abnormal noises is prevented, and an inner rotor having excellent durability is obtained.

DETAILED DESCRIPTION OF THE INVENTION

Figure 14:
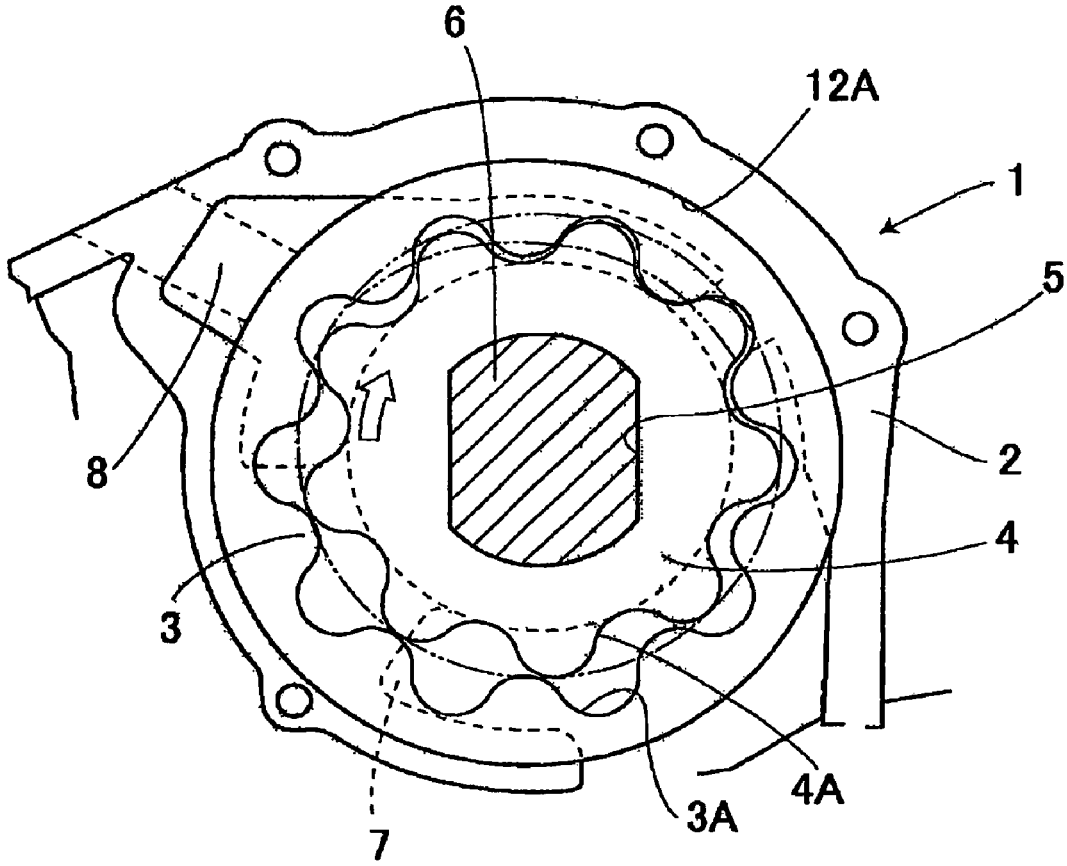
FIG. 14 (Prior Art)
FIG. 14 is a schematic diagram showing an internal gear pump.
Figure 15:
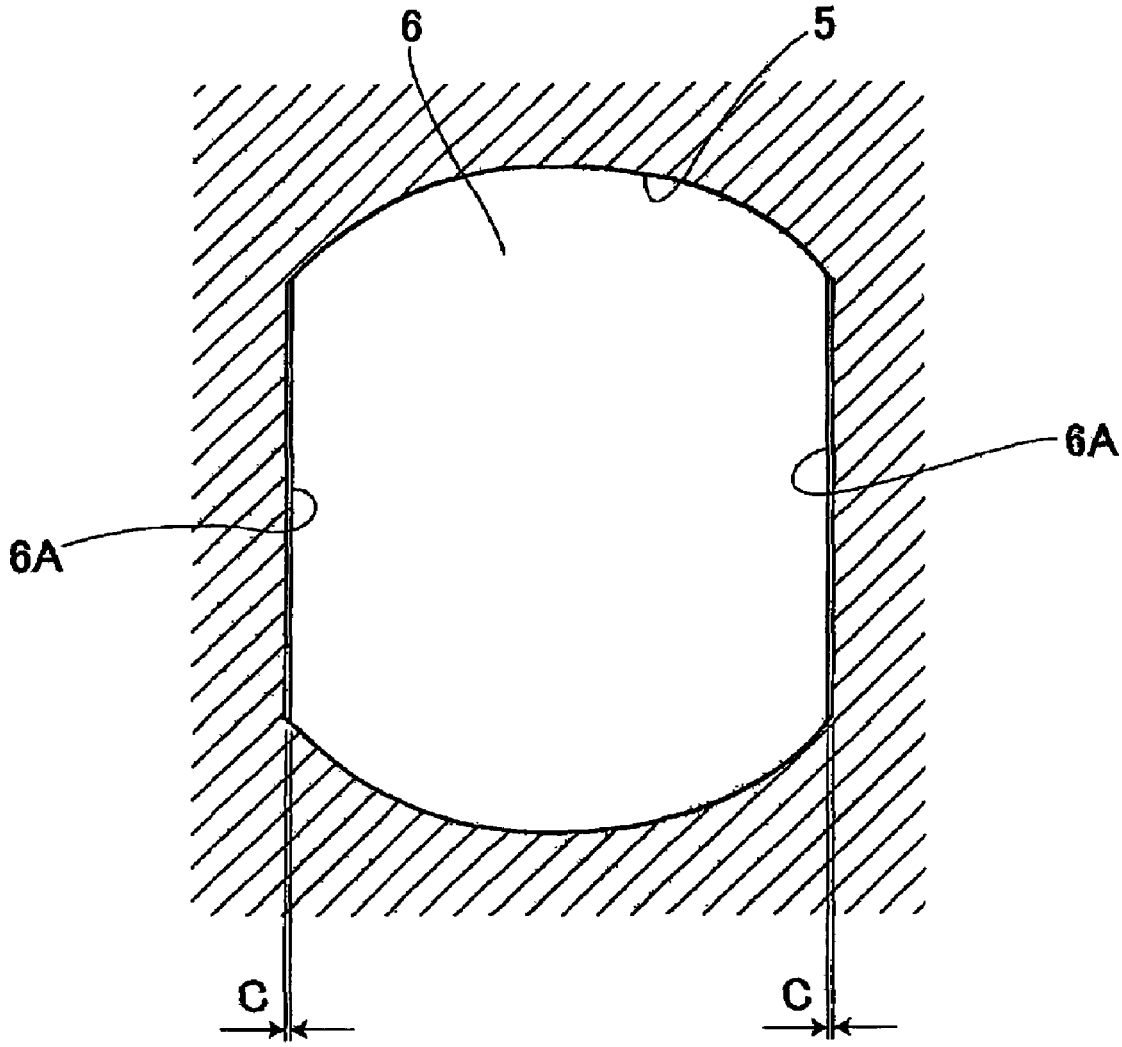
FIG. 15 (Prior Art)
FIG. 15 is a sectional view showing a mounting hole and a driving shaft of a conventional example.
Figure 16:
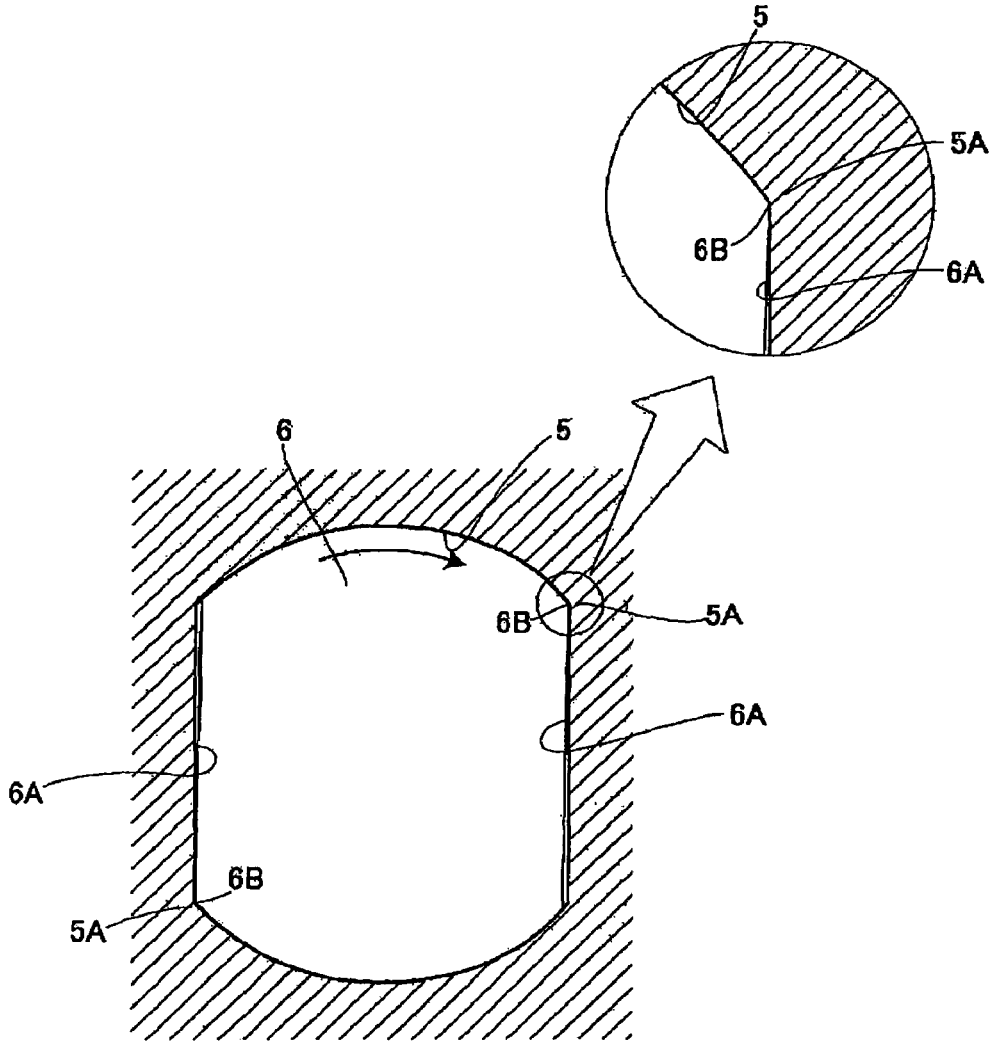
FIG. 16 (Prior Art)
FIG. 16 is a sectional view showing a mounting hole and a driving shaft in a rotation transmission state of a conventional example, with their portions being partially enlarged.

Hereinafter, embodiments of an inner rotor of an internal gear pump of the present invention will be described with reference to the accompanying drawings. In addition, the parts described with reference to FIGS. 14 to 16 are denoted by the same reference symbols, and detailed description thereof is omitted.

Figure 1:
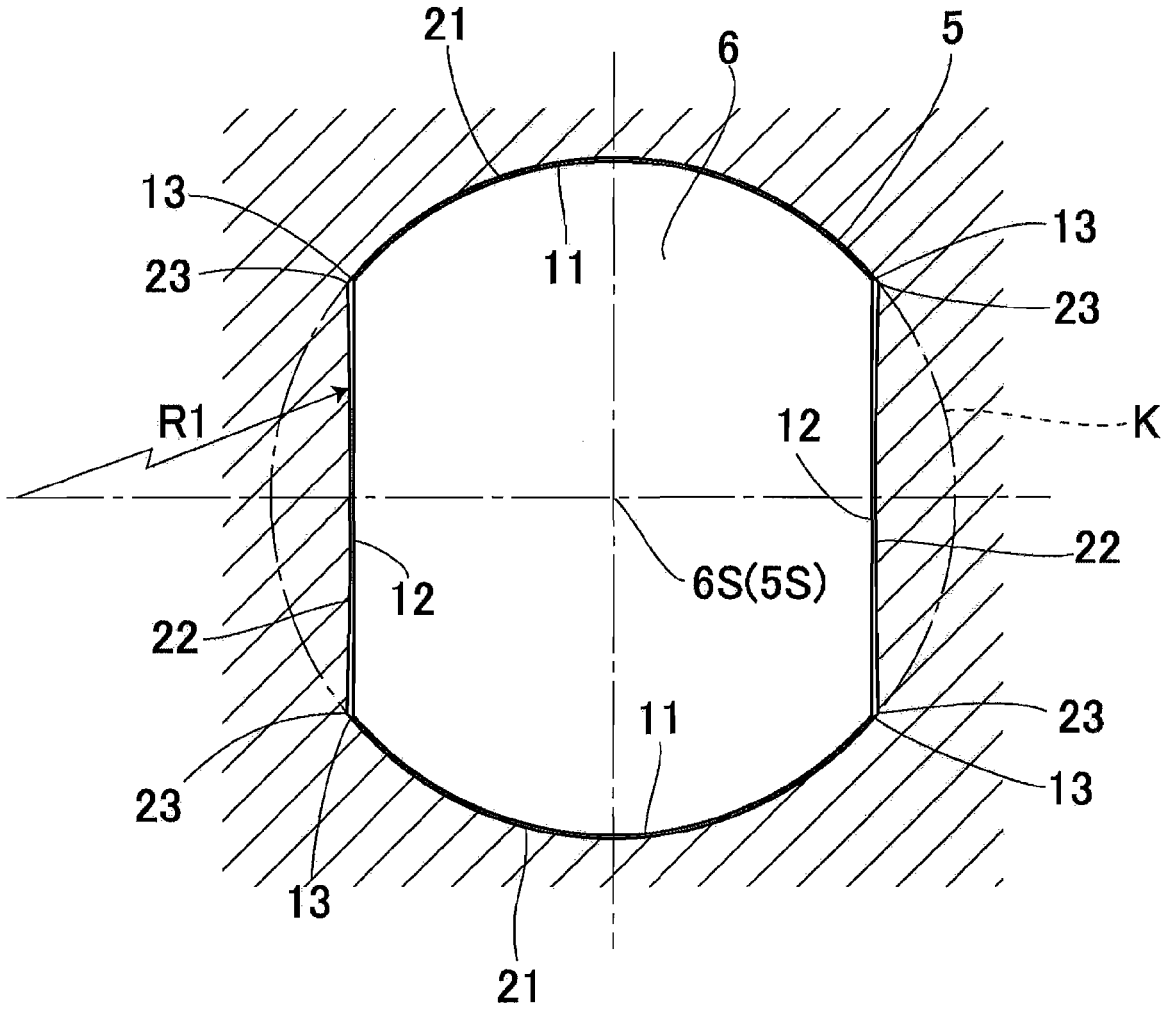
FIG. 1 is a sectional view showing a mounting hole and a driving shaft of a first embodiment of the present invention.
Figure 2:
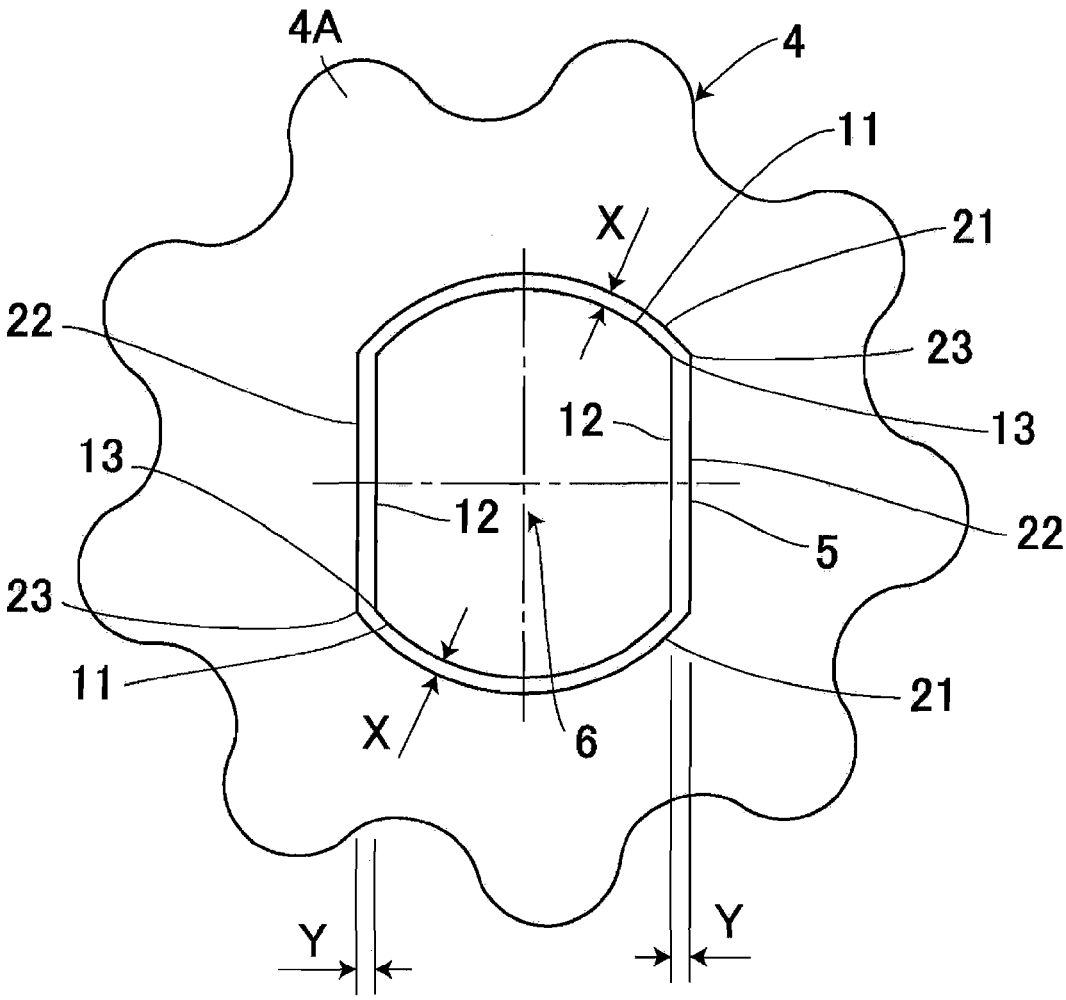
FIG. 2 is a front explanatory view showing an inner rotor and the driving shaft of the first embodiment of the present invention.
Figure 3:
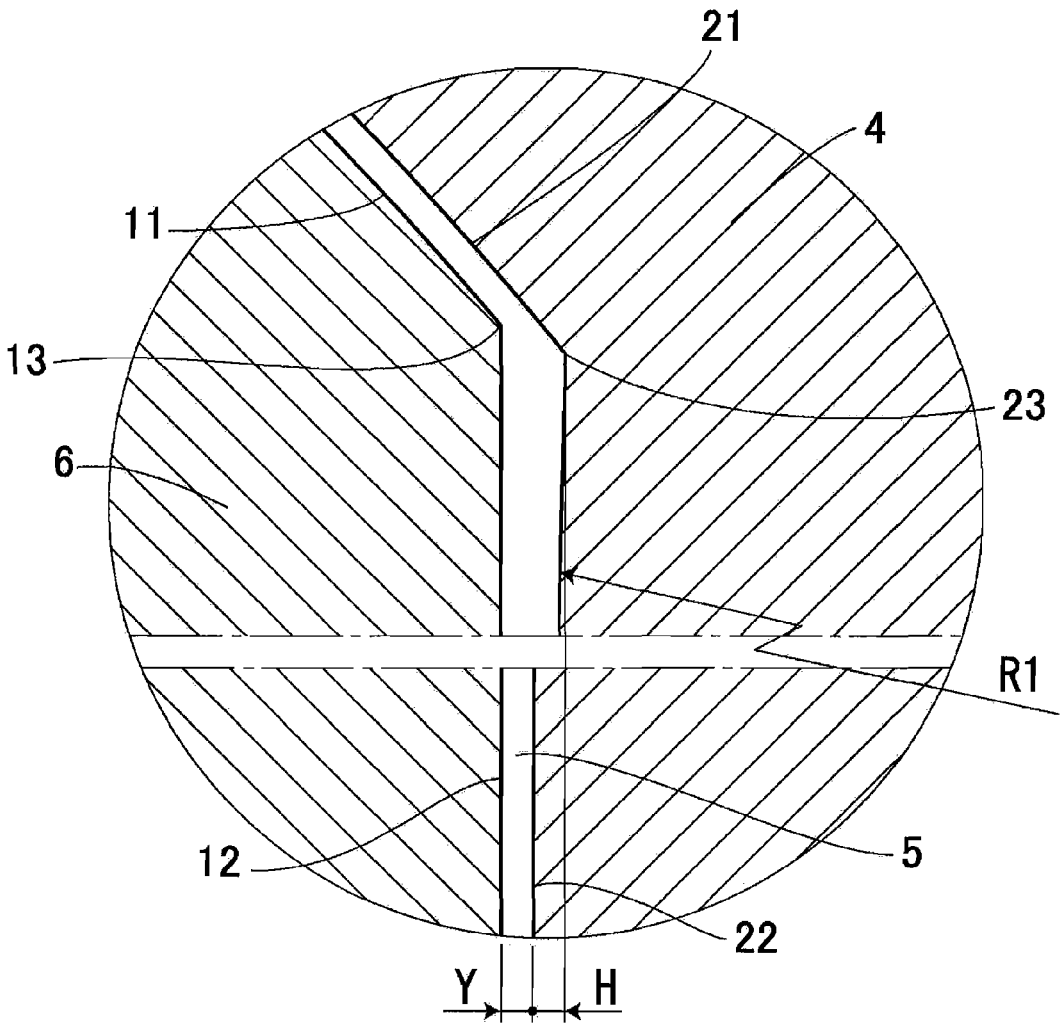
FIG. 3 is an enlarged sectional view showing principal parts of the mounting hole and the driving shaft of the first embodiment of the present invention.

FIGS. 1 to 3 show a first embodiment of the present invention. In these drawings, the crankshaft 6 has two main circular arc parts 11 located on the same circle around an axis 6S thereof, and linear connecting parts 12 which connect ends of the main circular arc parts 11 adjacent to each other in the circumferential direction. The crankshaft 6 has a cross-sectional shape in which the connecting parts 12, which face each other with the axis 6S as the centers thereof, are parallel with each other, and which is symmetrical in four directions. An intersection of the main circular arc part 11 and the connecting part 12 is a corner 13. As such, the cross section of the crankshaft 6 is formed in a substantially oval shape. In actual manufacturing processes, the cross section of the crankshaft is obtained, for example, by using a shaft having a circular cross section and made of carbon steel, such as S45C, and by forming two places of an outer peripheral surface of the shaft into flat surfaces.

The mounting hole 5 formed in the inner rotor 4 has two main circular arc parts 21 located on the same circle around an axis 5S thereof, and linear connecting parts 22 which connect ends of the main circular arc parts 21 adjacent to each other in the circumferential direction. The mounting hole 5 has a cross-sectional shape in which the connecting parts 22 which face each other with the axis 5S as the centers thereof are parallel with each other and which is symmetrical in four directions. An intersection of the main circular arc part 21 and the connecting part 22 is a corner 23. Moreover, the symbol K in the drawing denotes a basic circle of the mounting hole 5, and the main circular arc part 21 is located on this basic circle K.

As shown in the explanatory view of FIG. 2, the clearance X between the main circular arc parts 11 and 21 is set to 0.5 mm, and the clearance Y between the connecting parts 12 and 22 is set to 0.05 to 0.25 mm.

Moreover, the connecting part 22 of the mounting hole 5 is formed in the shape of a large circular arc which projects inward. This connecting part 22 projects to the greatest at a middle part thereof, and is recessed at ends thereof. The dimension between the middle part and the linear connecting part 12 of the crankshaft 6 is set to a dimension of the clearance Y. The corners 23 are formed at both ends of the connecting part 22 of the mounting hole 5. The projection height H of the connecting part 22 is 0.05 to 0.25 mm. In addition, this projection height H is the difference in height between the middle part of the connecting part 22 and the corners 23 at both ends of the connecting part. Moreover, the radius R1 of the connecting part 22 is determined depending on the dimension of each part of the mounting hole 5, and the projection height H. In this case, if the projection height H is less than 0.05 mm, the curvature of the radius R becomes excessively large, and thus the effect of reducing a stress generated in contact with the crankshaft 6 is not obtained sufficiently. Moreover, if the projection height H exceeds 0.25 mm, this results in a large deviation of a part contacting the crankshaft 6 in the central axis direction. That is, the clearance between the contact part and the axis 6S becomes narrow, and the stress generated with respect to the same transmission torque tends to rise strongly. This should be avoided.

In addition, although the connecting part 22 is shown in a straight line in FIG. 2 for description, all the connecting parts 22 form a circular arc shape.

Moreover, the inner rotor 4 is a Fe—Cu—C-based sintered member containing Fe as its main component, and is obtained by compacting raw powder to form a green compact, and sintering the green compact. In this embodiment, the crankshaft 6 is used for a prime mover, such as an engine, and the internal gear pump 1 is an internal gear-type oil pump of the prime mover. In order to satisfy this use condition, the density of the inner rotor 4 is set to 6.6 to 7.0 $cm^3$ (6.6 $cm^3$ or more and 7.0 $cm^3$ or less). Moreover, the tensile strength of the inner rotor 4 is about 35 to 40 $kg/mm^2$.

Next, the operation will now be described on the basis of the above configuration. First, since the clearance Y is provided between the middle parts of the linear connecting part 12 and the connecting part 22, when the prime mover is driven to rotate the crankshaft 6, the corner 13 of the main circular arc part 11 of the crankshaft 6 on the forward in the direction of rotation thereof abuts the connecting part 22, which forms a large circular arc shape, of the mounting hole 5 whereby torque is transmitted to the inner rotor 4.

Accordingly, at the time of rotation of the crankshaft, the linear connecting part 12 of the crankshaft 6 that is a flat surface and the circular arc connecting part 22 of the mounting hole 5 that is a curved surface come into line contact with each other whereby torque is transmitted to the mounting hole 5 from the crankshaft 6. Therefore, compared with a case where torque is transmitted by contact between corners, any local stress concentration in the mounting hole 5 can be prevented.

As described above, in the present embodiment, the inner rotor 4 of an internal gear pump is provided in which the mounting hole 5 which allows the crankshaft 6 as a driving shaft to be inserted therethrough is formed, the mounting hole 5 has a cross-sectional shape substantially corresponding to the crankshaft 6, and torque is transmitted by the crankshaft 6 inserted into the mounting hole 5. The crankshaft 6 and the mounting hole 5 have the two main circular arc parts 11 and 21 on the same circle, and the two connecting parts 12 and 22 which connect the adjacent ends of the main circular arc parts 11 and 21. The connecting parts 12 and 22 which face each other have a substantially parallel cross-sectional shape. The ends of each connecting part 22 of the mounting hole 5 are recessed. Therefore, the corner 13 of the crankshaft 6 does not hit against the corner 23 of the mounting hole 5. As a result, any stress concentration caused by the transmission of rotation between corners can be relieved.

Moreover, as described above, in the present embodiment, the connecting part 22 of the mounting hole 5 is formed in the shape of a large circular arc which projects inward. Therefore, the torque of the crankshaft 6 is transmitted to the mounting hole 5 in a state where the connecting part 12 of the crankshaft 6 and the connecting part 22 of the mounting hole 5 which forms a large circular arc shape come into line contact with each other. Therefore, the value of any local stress generated in the mounting hole 5 can be reduced.

Moreover, as described above, in the present embodiment, the inner rotor 4 is a ferrous sintered member. Therefore, shaping of the mounting hole 5 is easy.

Moreover, as described above, in the present embodiment, the sintered member is an Fe—Cu—C-based sintered member having a density of 6.6 to 7.0 $cm^3$. Therefore, parts having a lower density than a conventional article can be used, and product cost can be reduced.

Moreover, as described above, in the present embodiment, the driving shaft is connected to the crankshaft 6 of the prime mover. Therefore, even under the vibrating conditions of the prime mover, generation of abnormal noises is prevented and an inner rotor having excellent durability is obtained.

Figure 4:
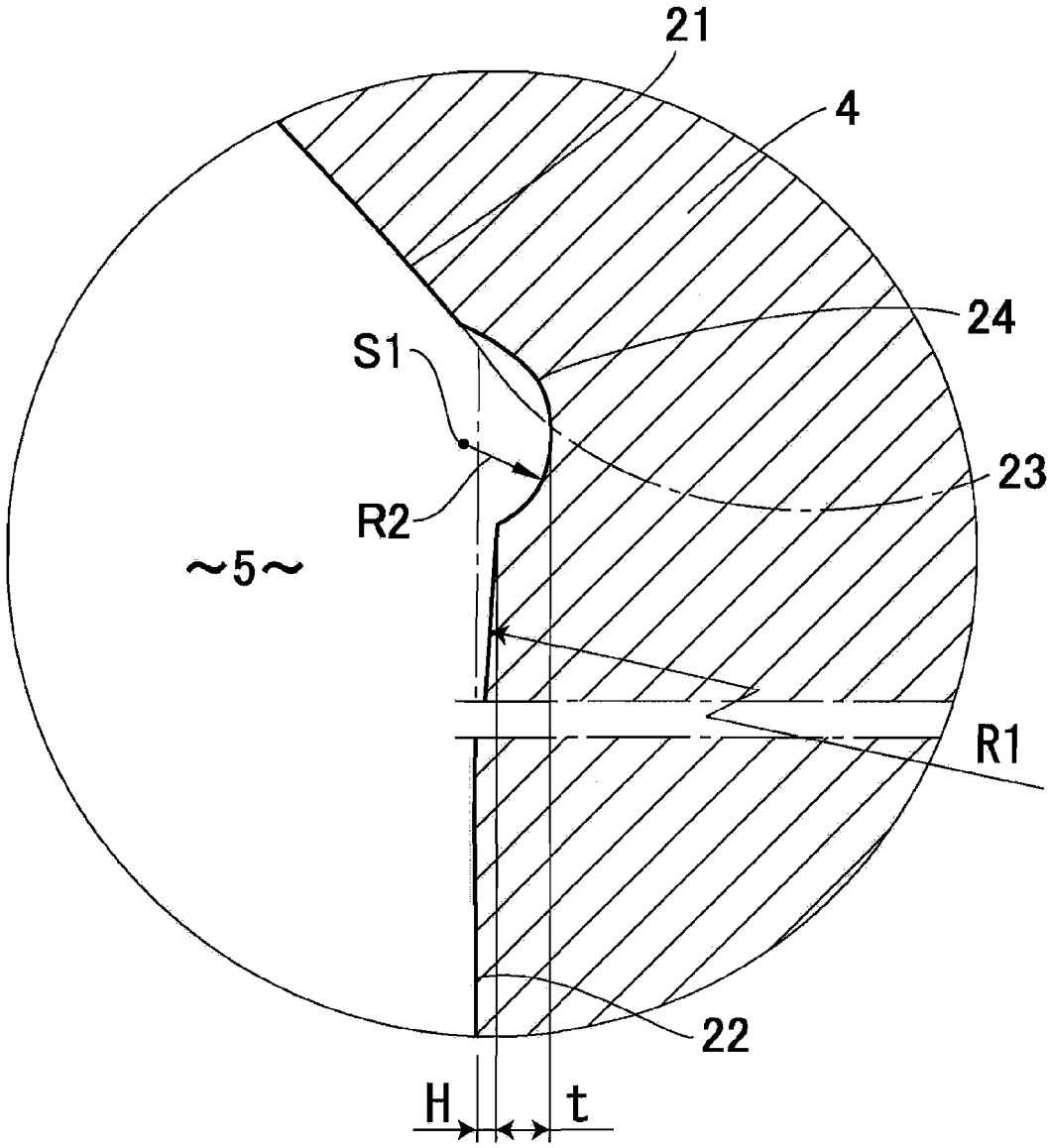
FIG. 4 is an enlarged sectional view showing principal parts of a mounting hole of a second embodiment of the present invention.
Figure 5:
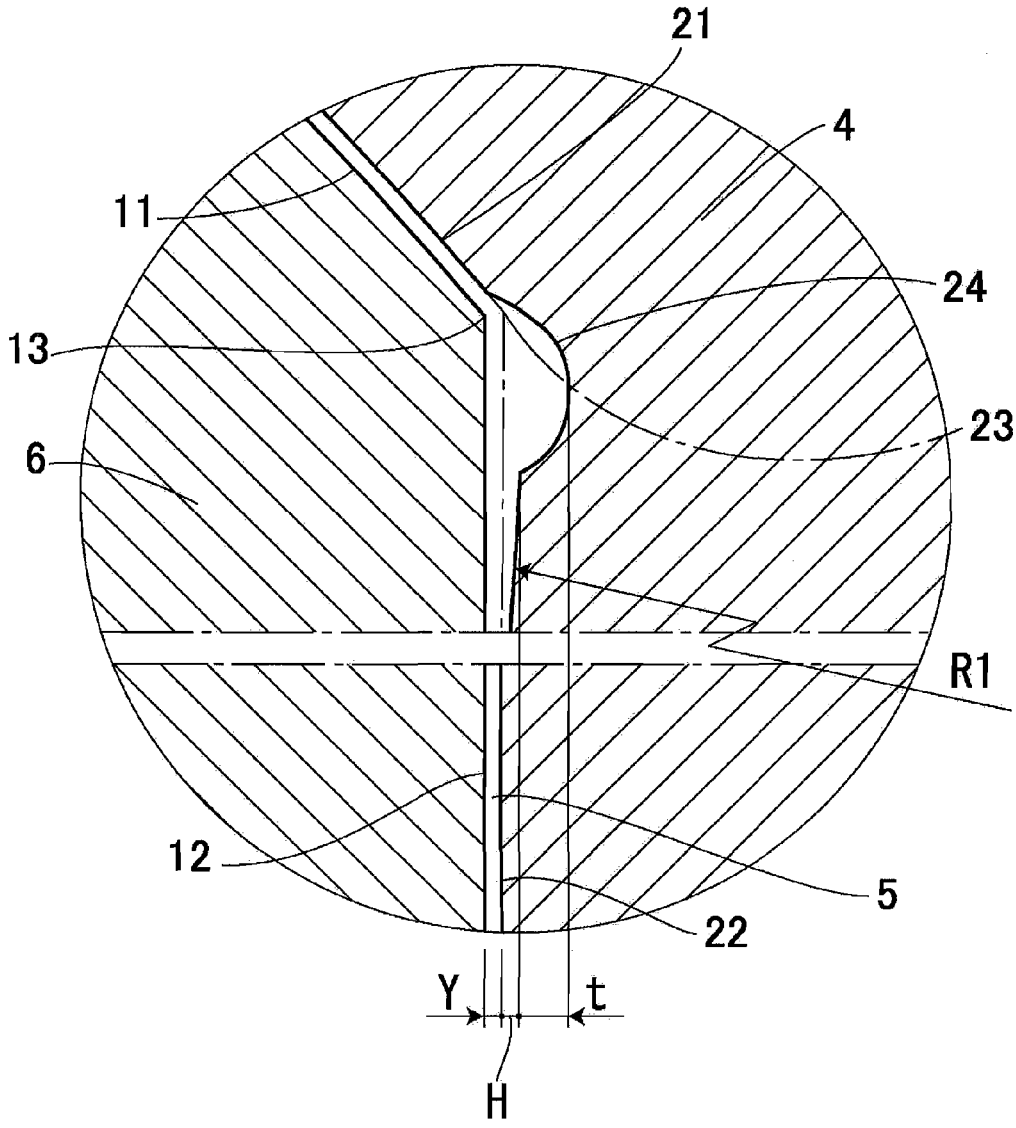
FIG. 5 is an enlarged sectional view showing principal parts of the mounting hole and a driving shaft of the second embodiment of the present invention.

FIGS. 4 to 5 show a second embodiment of the present invention. In these drawings, the same parts as those of the above embodiment are denoted by the same reference symbols, and detailed description thereof is omitted herein. In this embodiment, the corner 23 of the mounting hole 5 is constituted by a circular arc cutout 24 as a recess having a small radius. This circular arc cutout 24 is recessed. In addition, the small radius of the circular arc cutout 24 means that the radius of the circular arc cutout 24 is at least smaller than the radius of the main circular arc part 21.

As shown in FIG. 4, the center S1 of the circular arc cutout 24 is located in the mounting hole 5, and the radius R2 of the circular arc cutout is set to 1 to 5 mm. Moreover, the depth "t" of the circular arc cutout 24 with respect to the large circular arc connecting part 22 is set to 0.5 to 2 mm. In this case, there is a possibility that, if the radius R2 is less than 1 mm, stress concentration may become large, which is not preferable, and if the radius R2 exceeds 5 mm, the area of a transmission part between the crankshaft 6 and the inner rotor 4 may become small, and consequently any stress generated may become excessive. Moreover, there is a problem in that, if the depth "t" is less than 0.5 mm, the circular arc cutout does not serve as a cutout, and if the depth t exceeds 2 mm, the strength of the inner rotor 4 is reduced largely.

Accordingly, the corner 13 of the crankshaft 6 is prevented from hitting against the mounting hole 5 by providing the circular arc cutout 24 in the corner 23 that is an intersection part of the main circular arc part 21 and the large circular arc connecting part 22.

As described above, in the present embodiment, the circular arc cutout 24 having a small radius, which is a recess that is recessed, is provided at the corner 23 of the mounting hole 5 so as to correspond to corner 13 of the driving shaft as a connecting part between the main circular arc part 11 and the connecting part 12. Therefore, the corner 13 of the crankshaft 6 does not hit against the corner 23 of the mounting hole 5, and consequently, any stress generated in the vicinity of the corner 23 of the mounting hole 5 can be reduced.

Moreover, as described above, in the present embodiment, the recess is composed of the circular arc cutout 24 having a small radius. Therefore, any stress generated in the vicinity of the corner of the mounting hole 5 can be reduced.

Figure 6:
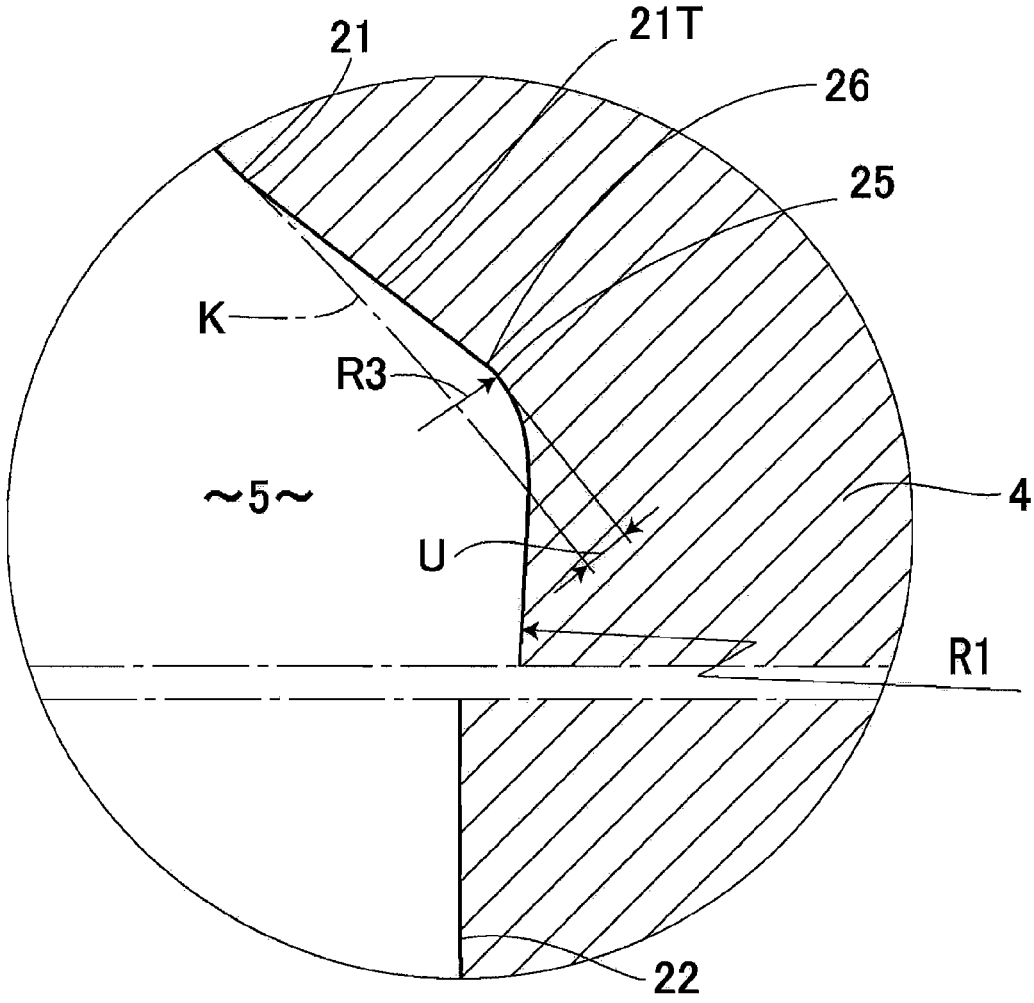
FIG. 6 is an enlarged sectional view showing principal parts of a mounting hole of a third embodiment of the present invention.
Figure 7:
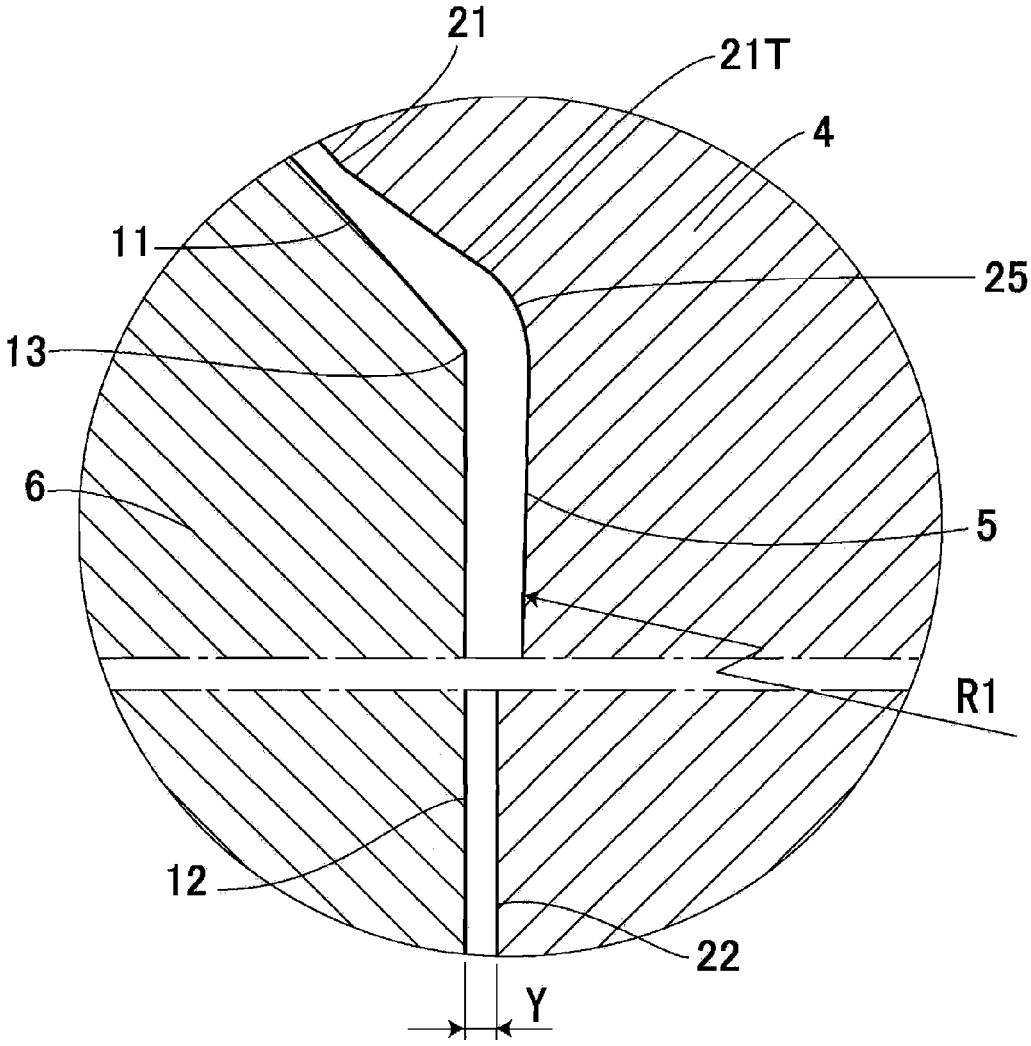
FIG. 7 is an enlarged sectional view showing principal parts of the mounting hole and a driving shaft of the third embodiment of the present invention.

FIGS. 6 to 7 show a third embodiment of the present invention. In these drawings, the same parts as those of the above respective embodiments are denoted by the same reference symbols, and detailed description thereof is omitted herein. In this embodiment, an escape recess 25 as a recess is formed at the corner of the mounting hole 5. This escape recess 25 is formed by recessing an end 21T of the main circular arc part 21, and the end 21T and an end of the connecting part 22 are connected together by a circular arc corner 26. The end 21T is located outside the basic circle K. In this embodiment, the end 21T is a tangential line of the basic circle K. Also, the end 21T and the end of the connecting part 22 are connected by the circular arc corner 26. The radius R3 of the circular arc corner 26 is 1 to 5 mm, and the depth U of the circular arc corner 26 with respect to the basic circle K is set to 0.5 to 2 mm. In this case, there is a possibility that, if the radius R3 is less than 1 mm, stress concentration may be caused, and if the radius R3 exceeds 5 mm, the area of a contact part between the crankshaft 6 and the inner rotor 4 may become small, and consequently, any stress may become excessive. Moreover, if the depth U is less than 0.5 mm, the escape effect is insufficient, and if the depth U exceeds 2 mm, the strength of the inner rotor 4 is largely reduced. This is not preferable.

Accordingly, the corner 13 of the crankshaft 6 is prevented from hitting against the mounting hole 5 by providing the escape recess 25 in the corner that is an intersection part of the main circular arc part 21 and the linear connecting part 22.

As described above, in the present embodiment, the connecting part 22 is formed in the shape of a large circular arc which projects inward, and the escape recess 25 as a recess is provided. Therefore, the same operation and effects as the above respective embodiments are exhibited.

Moreover, as described above, in the present embodiment, the recess is formed by recessing the end 21T of the main circular arc part 21 of the mounting hole 5. Therefore, any stress generated in the vicinity of a corner of the mounting hole 5 can be reduced.

Figure 8:
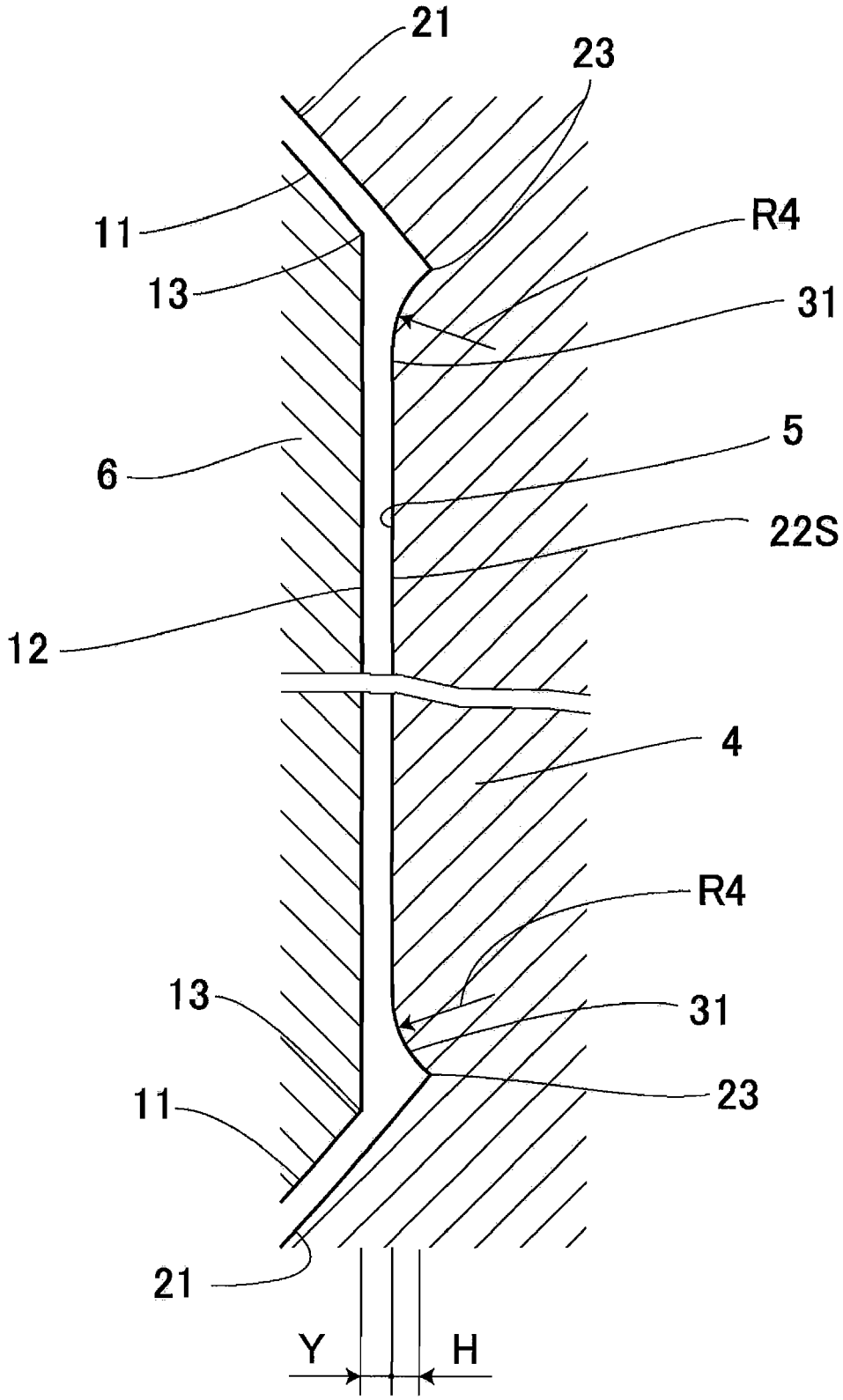
FIG. 8 is an enlarged sectional view showing principal parts of a mounting hole and a driving shaft of a fourth embodiment of the present invention.

FIG. 8 shows a fourth embodiment of the present invention. In this drawing, the same parts as those of the above respective embodiments are denoted by the same reference symbols, and detailed description thereof is omitted herein. In this embodiment, a connecting part 22S which connects the main circular arc parts 21 is formed in the shape of a straight line, and convex small circular arc parts 31 having a small radius are provided at both ends of the linear connecting part 22S. A corner 23 is formed at each end of the convex small circular arc part 31. The projection height H of the linear connecting part 22S is 0.05 to 0.25 mm, and the radius R4 of the convex small circular arc part 31 is 3 to 15 mm. In addition, the projection height is the difference in height between the connecting part 22S and the corner 23. In this case, there is a possibility that, if the projection height H is less than 0.05 mm, the fabrication precision of the inner rotor 4 may tend to be influenced, and thus the object of relaxing any stress may not be achieved sufficiently. There is also a possibility that, if the projection height H exceeds 0.25 mm, the effect of relaxing any stress may not be enhanced, and even if the projection height increases above this value, the strength of the inner rotor 4 is reduced instead. There is also a possibility that, if the corner has a small radius R4 of curvature, stress may become excessive, and if the corner has a large radius of curvature, a part contacting the crankshaft 6 may move in the central axis direction, and thus sufficient torque transmission may be hindered. Therefore, a range of 3 to 15 mm is preferable.

Accordingly, at the time of rotation of the crankshaft, the linear connecting part 12 of the crankshaft 6 that is a flat surface and the convex small circular arc part 31 of the mounting hole 5 that is a curved surface come into line contact with each other, or the linear connecting part 12 and the connecting part 22S come into surface contact with each other, whereby torque is transmitted to the mounting hole 5 from the crankshaft 6. Therefore, compared with a case where torque is transmitted by contact between corners, any local stress concentration in the mounting hole 5 can be prevented.

As described above, in the present embodiment, the crankshaft 6 has the two main circular arc parts 11 on the same circle and the two connecting parts 12 which connect adjacent ends of the main circular arc parts 11. The crankshaft 6 has a cross-sectional shape in which the connecting parts 12 which face each other are substantially parallel. The convex small circular arc parts 31 having a small radius are provided at both ends of the linear connecting part 22S of the mounting hole 5. Thus, the torque of the crankshaft 6 is transmitted to the mounting hole 5 in a state in which the connecting part 12 of the crankshaft 6 and one of the convex small circular arc parts 31 of the connecting part 22S of the mounting hole 5 come into line contact with each other or in a state in which the connecting part 12 of the crankshaft 6 and the connecting part 22S of the mounting hole 5 come into surface contact with each other. Therefore, the value of any local stress value generated in the mounting hole 5 can be reduced.

Figure 9:
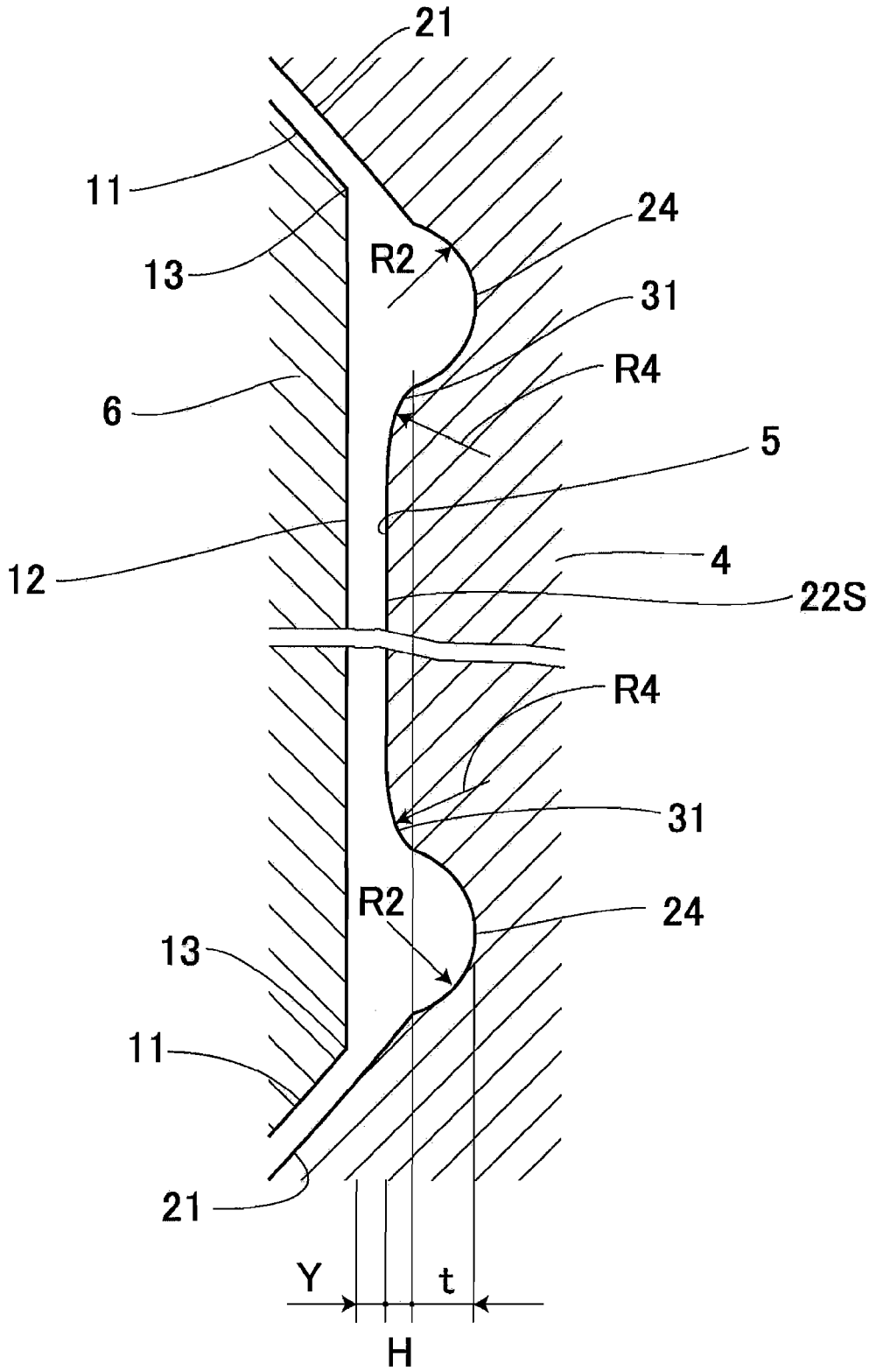
FIG. 9 is an enlarged sectional view showing principal parts of a mounting hole and a driving shaft of a fifth embodiment of the present invention.

FIG. 9 shows a fifth embodiment of the present invention. In this drawing, the same parts as those of the above respective embodiments are denoted by the same reference symbols, and detailed description thereof is omitted herein. In this embodiment, similarly to the fourth embodiment, the convex small circular arc parts 31 are provided at both ends of the middle linear connecting part 22S, and the circular arc cutout 24 is provided at each end of the convex small circular arc part 31. That is, a corner between the main circular arc part 21 and the convex small circular arc part 31 is formed as the circular arc cutout 24.

As described above, in the present embodiment, the convex small circular arc parts 31 having a small radius are provided at both ends of each of the connecting parts 22S of the mounting hole 5, and the circular arc cutout 24 as a recess is provided. Thus, the same operation and effects as the above respective embodiments are exhibited.

Figure 10:
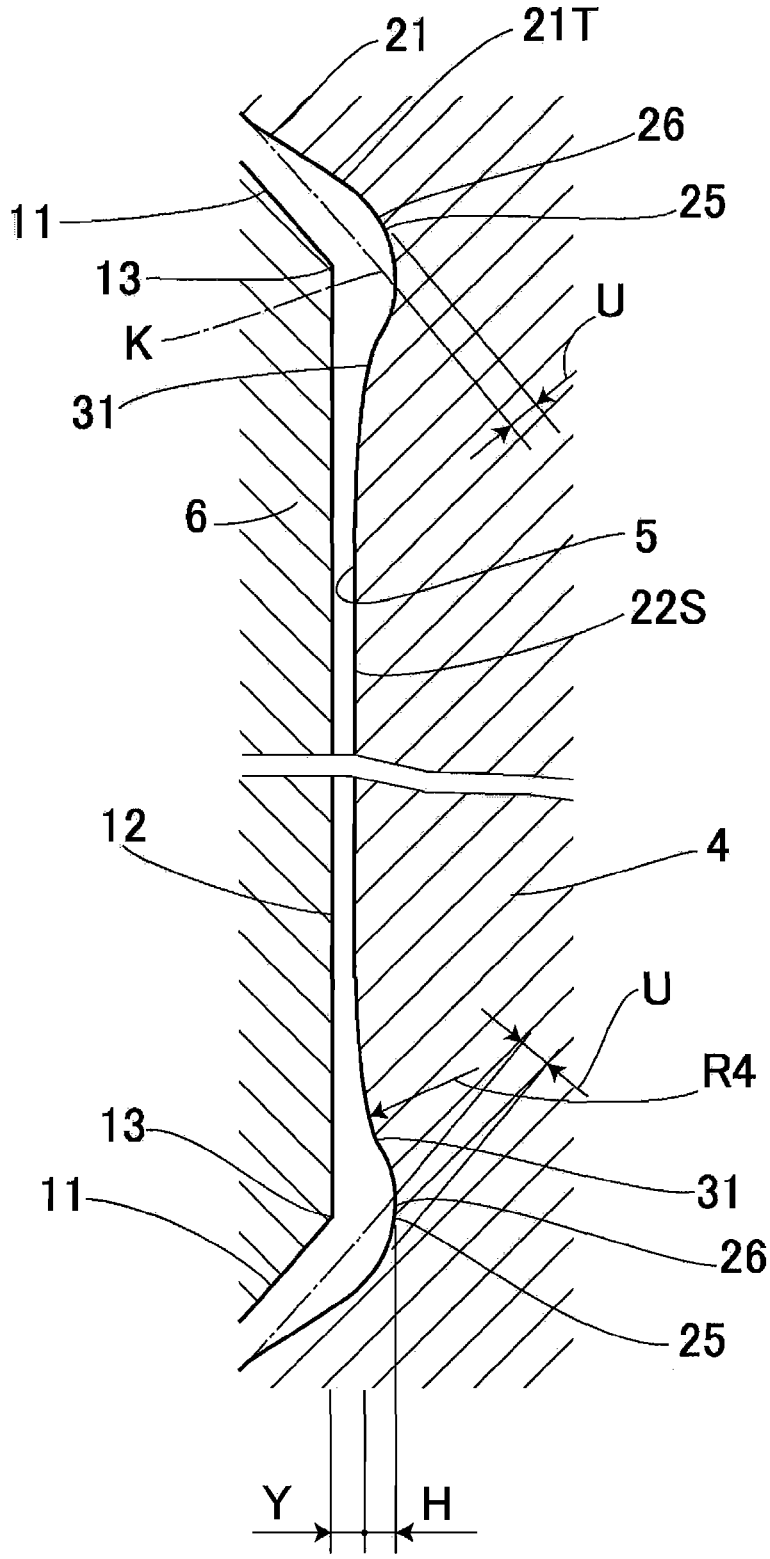
FIG. 10 is an enlarged sectional view showing principal parts of a mounting hole and a driving shaft of a sixth embodiment of the present invention.

FIG. 10 shows a sixth embodiment of the present invention. In this drawing, the same parts as those of the above respective embodiments are denoted by the same reference symbols, and detailed description thereof is omitted herein. In this embodiment, similarly to the fifth embodiment, the convex small circular arc parts 31 are provided at both ends of the middle linear connecting part 22S, and the escape recess 25 is provided between the end of the convex small circular arc part 31 and the main circular arc part 31.

As described above, in the present embodiment, the convex small circular arc parts 31 having a small radius are provided at both ends of each of the connecting parts 22S of the mounting hole 5, and the escape recess 25 as a recess is provided. Thus, the same operation and effects as the above respective embodiments are exhibited.

Figure 11:
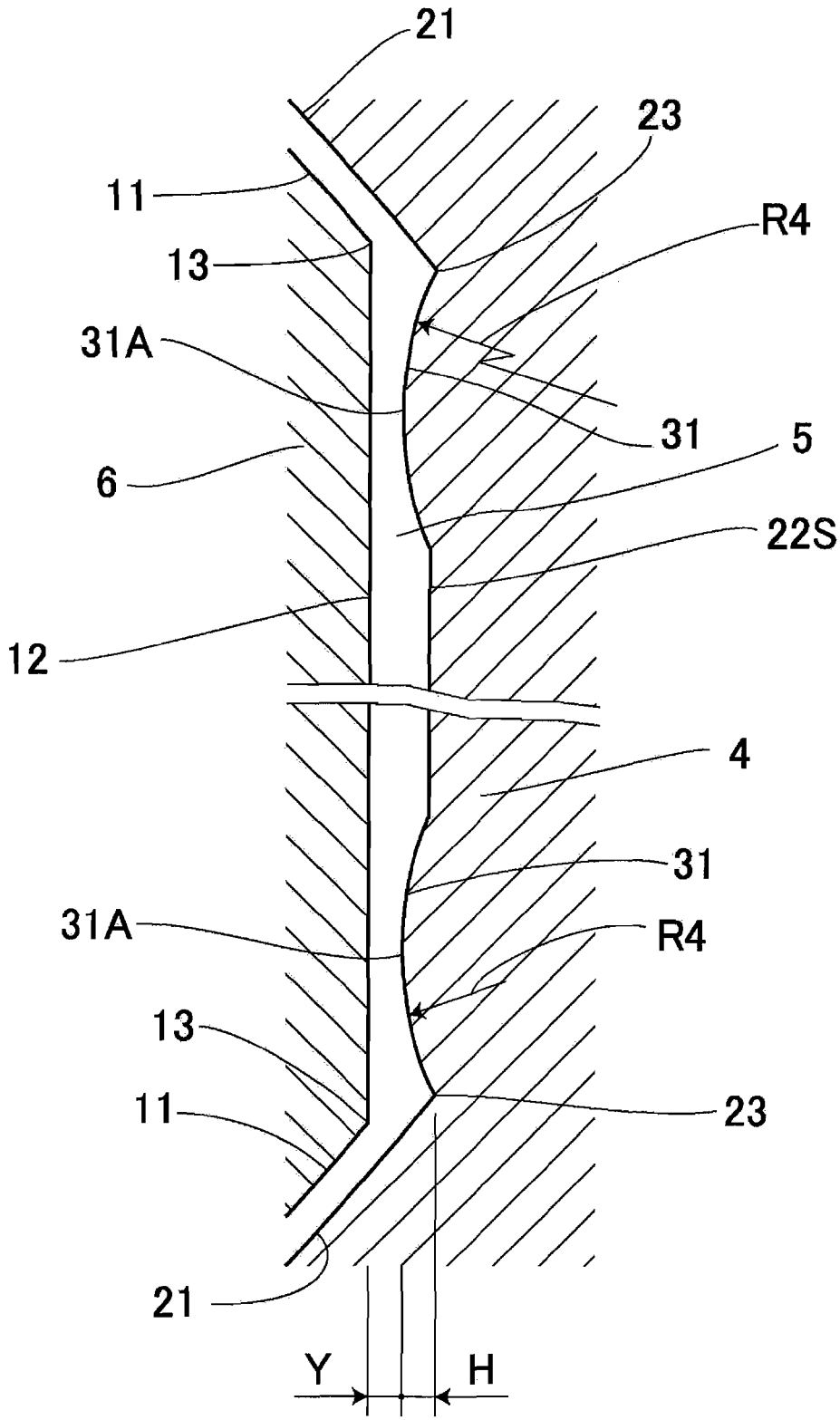
FIG. 11 is an enlarged sectional view showing principal parts of a mounting hole and a driving shaft of a seventh embodiment of the present invention.

FIG. 11 shows a seventh embodiment of the present invention. In this drawing, the same parts as those of the above respective embodiments are denoted by the same reference symbols, and detailed description thereof is omitted herein. In this embodiment, the linear connecting part 22S is located outside inner ends 31A of the convex small circular arc parts 31 and the clearance Y is formed between the inner end 31A of the convex small circular arc parts 31 and 31 and the connecting part 12 of the crankshaft 6. The projection height H of the convex small circular arc part 31 is 0.05 to 0.25 mm. In addition, this projection height H is the difference in height between the inner end 31A of the convex small circular arc part 31, and the corner 23, and is the difference in height between the inner end of the convex small circular arc part 31, and the connecting part 22S. The corner 23 is located on an extended line of the connecting part 22S. In addition, the connecting part 22S may be a linear line or a curved line so long as it is located outside an imaginary line which connects the inner ends 31A of the convex small circular arc parts 31 at both ends. In this case, there is a possibility that, if the projection height H is less than 0.05 mm, the fabrication precision of the inner rotor 4 may tend to be influenced, and thus the object of relaxing any stress may not be achieved sufficiently. There is also a possibility that, if the projection height H exceeds 0.25 mm, the effect of relaxing any stress may not be enhanced, and even if the projection height increases beyond the above value, the strength of the inner rotor 4 is reduced instead. There is also a possibility that, if the corner has a small radius R4 of curvature, stress may become excessive, and if the corner has a large radius of curvature, a part contacting the crankshaft 6 may move in the central axis direction, and thus sufficient torque transmission may be hindered. Therefore, a range of 3 to 15 mm is preferable.

Accordingly, at the time of rotation of the crankshaft, the linear connecting part 12 of the crankshaft 6 that is a flat surface and the convex small circular arc part 31 of the mounting hole 5 that is a curved surface come into line contact with each other, or the linear connecting part 12 and the inner ends 31A of the convex small circular arc parts 31 come into line contact with each other, whereby torque is transmitted to the mounting hole 5 from the crankshaft 6. Therefore, compared with a case where torque is transmitted by contact between corners, any local stress concentration in the mounting hole 5 can be prevented.

As described above, in the present embodiment, the convex small circular arc parts 31 having a small radius are provided at both ends of each of the connecting parts 22S of the mounting hole 5. Therefore, the torque of the crankshaft 6 is transmitted to the mounting hole 5 in a state where the connecting part 12 of the crankshaft 6 and any one or both of the convex small circular arc parts 31 of the connecting part 22S of the mounting hole 5 come into line contact with each other. Therefore, the value of any local stress generated in the mounting hole 5 can be reduced.

Moreover, as described above, in the present embodiment, the connecting part 22S is located outside the inner end 31A of the convex small circular arc part 31. Thus, the torque of the crankshaft is transmitted to the mounting hole in a state where the connecting part 12 of the crankshaft 6 hits against one of the convex small circular arc parts 31 or the inner ends 31A thereof. Therefore, the value of any local stress generated in the mounting hole 5 can be reduced.

Figure 12:
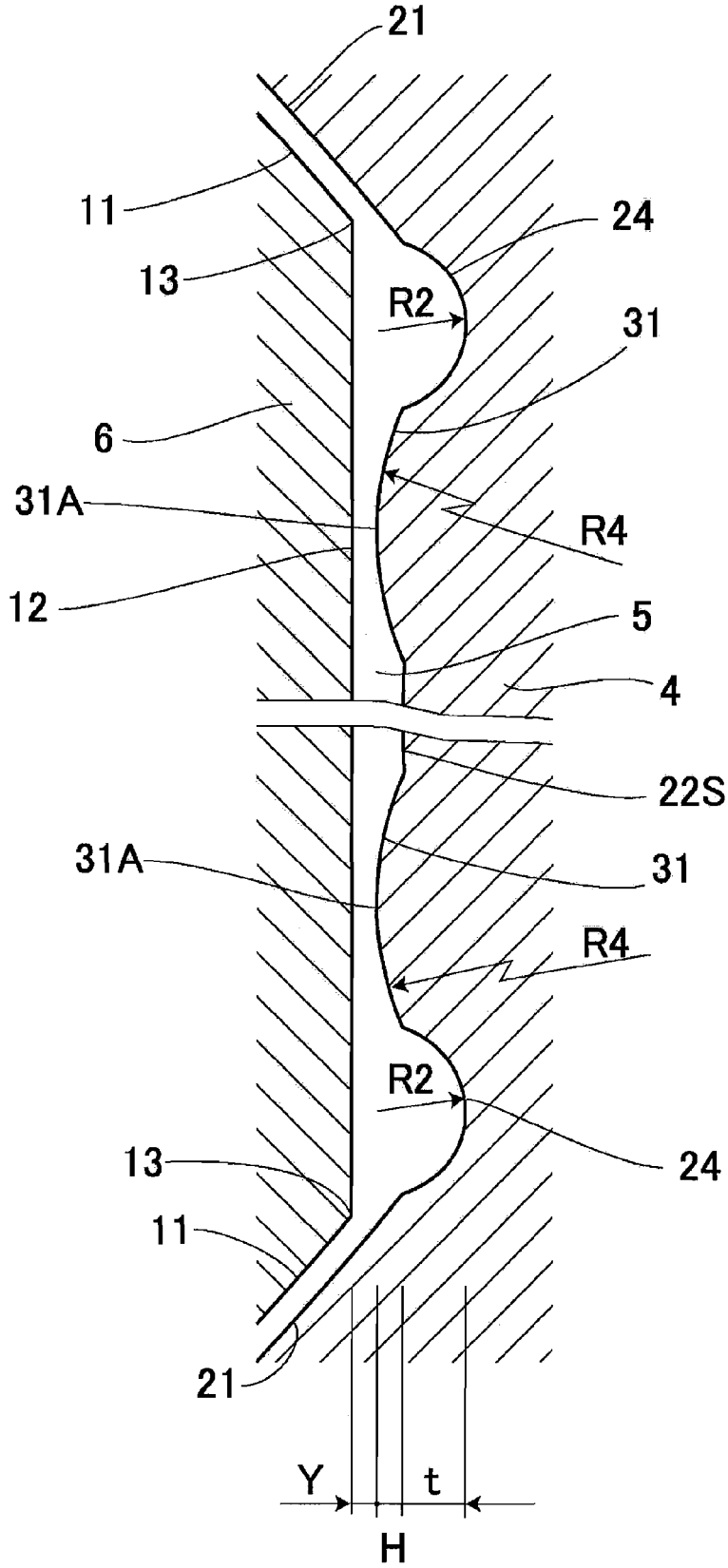
FIG. 12 is an enlarged sectional view showing principal parts of a mounting hole and a driving shaft of an eighth embodiment of the present invention.

FIG. 12 shows an eighth embodiment of the present invention. In this drawing, the same parts as those of the above respective embodiments are denoted by the same reference symbols, and detailed description thereof is omitted herein. In this embodiment, similarly to the seventh embodiment, the convex small circular arc parts 31 are provided at both ends of the middle linear connecting part 22S, and the circular arc cutout 24 is provided at each end of the convex small circular arc part 31. That is, a corner between the main circular arc part 21 and the convex small circular arc part 31 is formed as the circular arc cutout 24.

As described above, in the present embodiment, the convex small circular arc parts 31 having a small radius are provided at both ends of each of the connecting parts 22S of the mounting hole 5, and the circular arc cutout 24 as a recess is provided. Thus, the same operation and effects as the above respective embodiments are exhibited.

Figure 13:
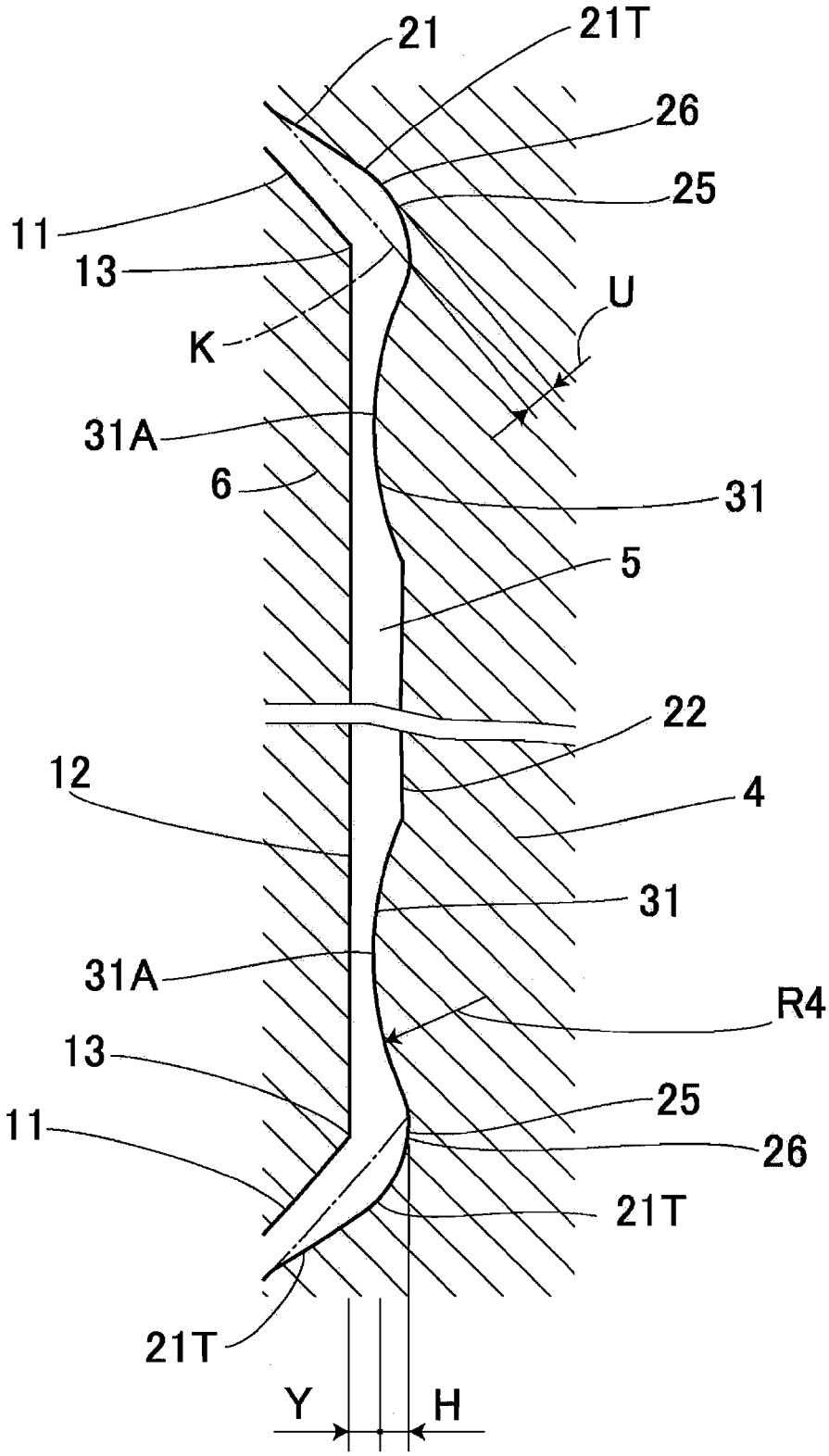
FIG. 13 is an enlarged sectional view showing principal parts of a mounting hole and a driving shaft of a ninth embodiment of the present invention.

FIG. 13 shows a ninth embodiment of the present invention. In this drawing, the same parts as those of the above respective embodiments are denoted by the same reference symbols, and detailed description thereof is omitted herein. In this embodiment, similarly to the seventh embodiment, the convex small circular arc parts 31 and 31 are provided at both ends of the middle linear connecting part 22S, and the escape recess 25 is provided between the end of the convex small circular arc part 31 and the main circular arc portion 21.

As described above, in the present embodiment, the convex small circular arc parts 31 having a small radius are provided at both ends of each of the connecting parts 22S of the mounting hole 5, and the escape recess 25 as a recess is provided. Thus, the same operation and effects as the above respective embodiments are exhibited.

In addition, the present invention is not limited to the above embodiments, and various modifications thereof can be made.

The invention claimed is:

1. An inner rotor of an internal gear pump comprising a mounting hole that allows a driving shaft to be inserted thereinto is formed in an axis, the mounting hole having a cross-sectional shape substantially corresponding to the driving shaft, whereby torque is transmitted by the driving shaft, wherein the driving shaft and the mounting hole have a cross-sectional shape including two main circular arc parts on the same circle and two connecting parts which connect both adjacent ends of the main circular arc parts, and the connecting parts of the mounting hole are recessed at their ends, the inner rotor further comprises convex small circular arc parts having a small radius, the convex small circular arc parts being provided at both ends of each of the connecting parts of the mounting hole, and the connecting parts of the mounting hole are located outside inner ends of the convex small circular arc parts.

2. The inner rotor of an internal gear pump according to claim 1, further comprising recesses that are recessed which are provided at corners of the mounting hole so as to correspond to corners of the driving shaft in places where the main circular arc parts and the connecting parts are connected.

3. The inner rotor of an internal gear pump according to claim 2, wherein the recesses are circular arc cutouts having a small radius.

4. The inner rotor of an internal gear pump according to claim 2, wherein the recesses are formed by recessing ends of each of the main circular arc parts of the mounting hole.

5. The inner rotor of an internal gear pump according to claim 1, wherein the inner rotor is a ferrous sintered member.

6. The inner rotor of an internal gear pump according to claim 5, wherein the sintered member is an Fe—Cu—C-based sintered member having a density of 6.6 to 7.0 $cm^3$.

7. The inner rotor of an internal gear pump according to claim 1, wherein the driving shaft is connected to a crankshaft of a prime mover.

* * * * *

UNITED STATES PATENT AND TRADEMARK OFFICE

CERTIFICATE OF CORRECTION

PATENT NO. : 7,572,117 B2
APPLICATION NO. : 11/721228
DATED : August 11, 2009
INVENTOR(S) : Katsuaki Hosono It is certified that error appears in the above-identified patent and that said Letters Patent is hereby corrected as shown below:

On the Title page of the patent, Item (73) under Assignee's address, please delete "Nigata-ken" and insert -- Niigata-ken -- therefor.

Signed and Sealed this

Tenth Day of November, 2009

David J. Kappos

David J. Kappos
*Director of the United States Patent and Trademark Office*